United States Patent [19]

Benisek

[11] 4,201,805

[45] May 6, 1980

[54] ZIRCONIUM FLAME-RESIST, LOW SMOKE EMISSION TREATMENT

[75] Inventor: Ladislav Benisek, Ilkley, England

[73] Assignee: International Wool Secretariat, London, England

[21] Appl. No.: 853,460

[22] Filed: Nov. 21, 1977

Related U.S. Application Data

[63] Continuation-in-part of Ser. No. 703,912, Jul. 9, 1976, Pat. No. 4,160,051, which is a continuation of Ser. No. 235,866, Mar. 17, 1972, abandoned.

[30] Foreign Application Priority Data

Mar. 18, 1971 [GB] United Kingdom ..... 7214/71
Apr. 1, 1971 [GB] United Kingdom ..... 8412/71

[51] Int. Cl.[2] ..... D06M 3/02; C09K 3/28

[52] U.S. Cl. ..... 427/389; 8/128 R; 427/393.3

[58] Field of Search ..... 427/390 D, 390 E, 389; 8/128 R, 31

[56] References Cited

U.S. PATENT DOCUMENTS

| | | | |
|---|---|---|---|
| 2,424,262 | 7/1947 | Wainer | 428/921 |
| 3,372,039 | 3/1968 | Gagliardi | 427/390 E |
| 3,671,292 | 6/1972 | Hirshfeld et al. | 427/390 E |
| 3,954,402 | 5/1976 | Benisek | 8/128 R |

OTHER PUBLICATIONS

Blumenthal, *Rayon and Synthetic Textiles*, "Dyeing and Finishing", pp. 87–89, 10–1948.

Laurie, "Uptake of Metal Complexes", *Textile Research Journal*, pp. 476–480, May, 1966.

Benisek, "Improvement of the Natural Flame-Resistance of Wool", Textile Institute Journal, vol. 65, 1974, pp. 102–108.

*Primary Examiner*—John D. Smith

*Attorney, Agent, or Firm*—Dennis P. Clarke

[57] ABSTRACT

A method for improving both the flame-resist and smoke emission properties of natural polyamide fibers comprising applying thereto an anionic complex of zirconium, citric acid and fluoride at an acid pH.

6 Claims, No Drawings

ZIRCONIUM FLAME-RESIST, LOW SMOKE EMISSION TREATMENT

CROSS REFERENCE TO RELATED APPLICATIONS

This application is a continuation-in-part of application Ser. No. 703,912, filed July 9, 1976, now U.S. Pat. No. 4,160,051 which, in turn, is a continuation of application Ser. No. 235,866, filed Mar. 17, 1972 now abandoned.

BACKGROUND OF THE INVENTION

The present invention relates to polyamide textile finishing and more particularly to the improvement in the flame-resist and smoke emission properties of natural polyamide fibers.

Naturally occurring polyamide fibers, for example the wool of sheep, display a high degree of natural flame retardancy because of their relatively high nitrogen and moisture content, high ignition temperature (570°-600° C.), low heat of combustion, low flame temperature and high limiting oxygen index.

The performance of wool fabrics in the various test methods currently in use depends on the specified test method and fabric construction. A horizontal test method is much less severe than a 45° or a vertical test. Most wool fabrics will pass a horizontal test but may not pass some 45° or vertical tests. The influence of fabric construction is also very important, the denser and heavier the fabric the lower the flammability. For example, a conventional tufted pile wool carpet will pass the American "Tablet Test" (DOC FF- 1-70, DOC FF 2-70), while a carpet in the same material but having a loose or a longer pile may fail the same test.

It follows that wool in some cases needs a flame-resist treatment in order to pass a particular flammability specification and test method. Curtain and wall coverings in public buildings, aircraft furnishings and blankets, furnishings and curtains in general transport, protective clothing and carpets of shag pile construction and low density are products which may require treatment.

It has previously been proposed to apply titanium compounds to textile fibers as flame-proofing agents. Such compounds are not always suitable when wool fibers are used because they can cause yellowing. Moreover, although the process is satisfactory for many purposes, it is not entirely suitable for the manufacture of bleached wool articles.

In addition, the smoke emission characteristics of textile furnishings have recently come under careful scrunity by environmental agencies. Recently, the Federal Aviation Administration published proposed smoke emission standards for aircraft textile furnishings. Previously, these furnishings were only required to meet a vertical flame test standard.

BRIEF DESCRIPTION OF THE INVENTION

The present invention provides a process for improving the flame-resist and smoke emission properties of natural polyamide fibers comprising applying to the fibers an aqueous solution containing an anionic complex of zirconium, citric acid and fluoride, said solution having a pH in the range of 0.5 to 4.0 to impregnate the substance of the fibers with the anionic complex, the molar ratio of fluoride to zirconium being less than about 4.

DETAILED DESCRIPTION OF THE INVENTION

The present invention is predicated on the discovery that the application of an anionic zirconium complex of citric acid and fluoride wherein the molar ratio of fluoride to zirconium is less than about 4 to natural polyamide fibers not only improves the flame-resist properties of the fibers but also unexpectedly reduces the smoke emission characteristics of the fibers.

It was found that fluorocitratozirconate complexes with low F/Zr molar ratios, preferably below about 4, significantly decreased the smoke emission of natural polyamide fibers treated therewith as compared with complexes containing little or no organic complexing agent or complexes wherein the F/Zr ratio is, for example, 6 (a hexafluorozirconate). The proposed smoke emission standards specify a specific optical density after 4 minutes, i.e., $Ds_{t=4\ min}$ of not more than about 100. This smoke emission standard value is met by polyamide fibers treated in accordance with the invention by a fluorocitratozirconate wherein the F/Zr ratio is below about 4.

Smoke emission values were determined in the NBS Smoke Density Chamber according to NBS Technical Publication 708, Appendix II.

For satisfactory results, 2 to 12%, preferably 6 to 10%, of zirconium complex, calculated as zirconium dioxide on the weight of wool, is normally applied to the fibers. It is also preferred to apply the complex in the form of a solution having a pH of from about 0.5 to about 4. The complex may be preformed or formed in situ by reaction of a water soluble zirconium compound with a sufficient amount of citric acid and a fluoride.

Zirconium compounds which can be employed as starting materials include any water soluble zirconium compounds such as zirconium acetate, zirconium oxychloride (zirconyl chloride), zirconium sulphate, zirconium nitrate, and potassium zirconium fluoride.

As noted above, the molar ratio of fluoride to zirconium is maintained from 0 to about 4. Generally, it is desired to maintain the ratio at a value between about 2 and 3 and preferably about 2.5.

The amount of citric acid employed is not overly critical. It is sufficient that enough citric acid be maintained to insure the formation of a negatively charged fluorocitratozirconate complex and to avoid the formation of insoluble basic zirconium compounds which could affect the esthetics of the wool fabric. Preferably, the molar ratio of citric acid to zirconium may vary from about 1:1 to about 3:1. The lower molar ratios are applicable where fluoride is present whereas the higher molar ratios are utilized where the fluoride content is low or absent.

The solution is generally applied at a temperature in the range of from about 10° to about 100° C.

While the invention does not depend upon any particular theory as to its mode of operation, it is believed that the application of zirconium in the form of a complex enables the zirconium to penetrate into the interior of the fibre, especially when using wool fibers, which are preferred, where it can then react with, for example, amino groups within the fiber to become chemically bonded thereto. Furthermore, at the acid pH values used the wool is in a positively charged state, and a more satisfactory exhaustion of the zirconium is obtained when it is applied in the form of anionic complex ions.

The zirconium compound can be applied to the fibers by any conventional method, including the pad-dry, pad-batch, spray-nip-dry and the exhaustion method, which is preferred.

The term "pad-dry" as used herein means the method of applying a liquor or paste to fibers to be treated by padding followed by drying. The term "spray-nip-dry" means the method of spraying a liquor onto the fibers to be treated, passing them through a nip, and subsequently drying them. The term "exhaustion" means the method of treating the fibers in a bath with a solution of the active substance until it is substantially completely taken up, and subsequently drying them.

Conventional machinery for treating textiles and garments with liquors may be used, including dollies, winches, beam dyeing equipment, package dyeing machinery, hank dyeing machinery, top dyeing equipment, side paddle dyeing machines, washing and laundering equipment and dry cleaning machinery for batchwise treatments and including pad mangles, lick-rollers, spray units, continuous cloth washing units, back washing machines and solvent scouring machines for continuous and semi-continuous treatments.

The invention is especially valuable for the treatment of natural polyamide fibers. Preferably the fibers are of sheep's wool but they can also be derived from alpaca, cashmere, mohair, vicuna, guanaco, camel hair silk, and llama, or of blends of these materials with sheep's wool. Fabrics consisting of a blend containing major proportion of wool and a minor proportion, generally 20% or less, of synthetic fibers or natural cellulosic fibers which do not in themselves have a high degree of flame-resistance, for example polyamide, polyester or cotton fibers, may also be treated. It is also possible to treat blends containing less than 80% wool, the remainder comprising a flame-resistant man-made fiber, for example aromatic polyamide fibers (sold under the tradename NOMEX by E, I. DuPont de Nemours & Co.), polybenzimidazole fibers, cross-linked phenolic fibers (Kynol, Carborundum Co.) polyvinykl chloride fibers, polyvinylidine chloride fibers, modacrylic fibers and flame-resist treated rayon and cotton fibers. The treatment may be applied to the fibers at any desired stage during textile processing, and the fibers may, for example, be in the form of fleeces, tops card sliver, noils, yarns, threads, woven or knitted fabrics, non-woven fabrics, pile fabrics, garments or sheepskins. Preferably the material to be treated is scoured to a residual methylene chloride extract of not more than 0.8% in order to remove spinning additives or natural waxes which can contribute to the flammability of the product.

The fibers may additionally be treated with other known substances imparting flame-resist properties. Such substances include antimony compounds, especially antimony trifluoride or antimony potassium tartrate, and aluminum compounds, especially aluminum sulphate ($Al_2(SO_4)_3,16H_2O$), or aluminum chloride. Features of the principal methods for treating the fibers are described hereinafter.

(a) Exhaustion Method

The amount of zirconium exhausted on wool during the flame-resist treatment can be estimated as ash content (metal oxides). As wool always contains some inorganic matter the increase in ash content due to mordanting should always be estimated as the difference between the ash content of flame-resist treated and untreated wool during the treatment.

The present process may be carried out at the same time as dyeing provided that the dye is capable of exhausting onto wool at a pH below 5. Such dyes are generally water-soluble and contain anionic solubilizing groups. Acid leveling and 1:1 premetallized dyes can be applied simultaneously with the zirconium treatment and there is no need to add additional formic or sulphuric acid as is conventional with these dyes since the pH of the dyebath is already sufficiently low. Glauber's salt and sulphuric acid are preferably not to be added to the solution since they interfere with the exhaustion of the zirconium complex but organic nonionic leveling agents, for example, those sold under the tradenames Avolan SC or Albegal B can be used. When using an acid milling or 1:2 premetallized dye the dye can first be exhausted at the boil, the temperature of the dye bath is reduced to 70° C., the complexed zirconium compound is then added and the bath is then further heated until the zirconium complex has exhausted onto the wool. When dyeing with chrome dyes, the dyeing operation must be carried out before the zirconium treatment, otherwise, complex formation between the zirconium in the fiber and the dye in solution can give rise to a color change.

The zirconium treatment is very advantageous in that it does not give rise to yellow discoloration of the wool and does not promote yellowing on exposure to light and pastel shades are not significantly altered by the treatment. When no dye is added, the product has the natural color of the wool, and may, if desired, be bleached by treatment with a hydrogen peroxide bleach or a reductive bleach such as sodium hydrosulphite or bisulphite. Bleaching, when required, can be carried out after the zirconium treatment, or preferably, before the treatment provided that the temperatures used in the zirconium treatment do not approach boiling.

Reductive bleaching can be carried out by heating the wool with a stabilized hydrosulphite at a concentration of about 5 grams per liter at a temperature of 50°-70° C. for 1-2 hours. A milder reducing bleach can be obtained by boiling with sodium bisulphite (about 5 g/l) at 50° C. for 1 hour. Bleaching may be carried out using 0.3%-0.7% w/v hydrogen peroxide solution, and it is preferred to include a stabilizer based on silicates, for example 3-5 g/l sodium silicate and to maintain the treatment bath at 50° C. for 1-2 hours. If the wool has previously been damaged, for example by weather, then 4% formaldehyde 40% o.w.w. may be added to the zirconium treatment bath to protect the wool during boiling.

(b) Pad-batch method

The zirconium compound may be applied to the fibers to be treated in a pad mangle. The fibers can be dyed prior to treatment. A suitable treatment composition comprises an aqueous solution of zirconium acetate, ammonium bifluoride, citric acid, and formic acid. After treatment the fibers are wound onto a former and stored in the presence of moisture for about one hour, rinsed with water and dried. The pad-batch treatment is especially useful for the treatment of dyed fabrics wherein the dyestuff is not stable to high temperatures at pH 0.5 to 3.

The treatment according to the invention has the further advantage that it is compatible with fluorocarbon oil-and-water repellent treatments for upholstery fabrics for use, for example, on aircraft seats. Fluorocarbon resins, for example FC-214, FC-208, FC-218, all available from the 3M Company, can be applied preferably in the presence of an extender, for example Phobotex FTN (CIBA). The zirconium and fluorocarbon can be applied simultaneously by padding followed by drying at a temperature of at least 100° C., further heating for a period and at a temperature sufficient to cure the resin, washing and drying. The zirconium treatment can be also applied by any of the methods described herein before or after the water and oil-repellent treatment. With the fluorocarbon, a simultaneous zirconium and water- and oil-repellent treatment can be achieved utilizing the exhaustion technique.

(c) Spray-nip-dry method

A suitable composition for application to fabrics, especially pile fabrics, by spraying comprises an aqueous solution of zirconium oxychloride or acetate, ammonium bifluoride and citric acid, such a composition is especially useful for the treatment of made-up carpets.

The invention is illustrated by the following examples.

(The expression "o.w.w." means on the weight of wool).

(d) Flame resistance

The flame-resistance of textile fabrics can be measured by the Vertical Flame Test (A.A.T.C.C. Test Method 34-1969, Fire Resistance of Textile Fabrics) which involves suspending a conditioned (65% relative humidity) strip of the fabric to be tested in a flame of a Bunsen burner for twelve seconds and determining the length of the charred portion of the fabric and the burning time. The flame-resistance of carpets can be measured by the Tablet Test (U.S. Federal Specification DOC FF 1-70 which involves drying a specimen of the carpet at 105° C. for 2 hours, igniting a standard time-burning "Methanamine" (Hexamethylenetetramine) tablet on the surface of the carpet, and observing the spread of flame over the surface of the carpet. It is an object of the present invention to provide textile materials which pass these tests, hereinafter referred to as the "Vertical Flame Test" and "Tablet Test", respectively.

The invention will be illustrated by the following example:

EXAMPLE I

Samples of a wool fabric (490 g/m$^2$) were treated with solutions containing anionic zirconium complexes as set forth in the Table.

TABLE I

| Treatment | F/Zr Ratio | FLAME RESISTANCE AATCC 34 - 1969 Warp B.T. | Warp C.L. | Weft B.T. | Weft C.L. | Smoke Emission Flaming Conditions. Dm Corr | $SON_4$ | $Ds_{t=4\ min.}$ |
|---|---|---|---|---|---|---|---|---|
| 8% $ZrOCl_2 . 6H_2O$, 11.5% Citric Acid, 10% HCOOH, 30 min. boil | 0 | 8 | 2.4 | 20 | 4 | 99 | 211 | 76 |
| 10% $ZrOCl_2 . 6H_2O$, 13% Citric Acid, 10% HCOOH, 30 min. boil | 0 | 5 | 3 | 4 | 1 | | | |
| 8% $ZrOCl_2 . 6H_2O$, 0.8% $NH_4 . HF$, 10% Citric Acid, 10% HCOOH, 30 min. 70° C. | 1 | 4.4 | 1.5 | 4.5 | 1.5 | 106 | 197 | 72 |
| 8% $ZrOCl_2 . 6H_2O$, 1.6% $NH_4 . HF$, 8% Citric Acid, 10% HCOOH, 30 min. 70° C. | 2 | 1.2 | 1 | 1 | 0.8 | 103 | 198 | 70 |
| 8% $ZrOCl_2 . 6H_2O$, 2.4% $NH_4 . HF$, 6% Citric Acid, 10% HCOOH, 30 min. 70° C. | 3 | 1.5 | 1 | 1 | 1 | 125 | 261 | 93 |
| 8% $ZrOCl_2 . 6H_2O$, 3.2% $NH_4 . HF$, 4% Citric Acid, 10% HCOOH, 30 min. 70° C. | 4 | 0 | 0.7 | 4 | 1.7 | 148 | 292 | 109 |
| 8% $ZrOCl_2 . 6H_2O$, 4.0% $NH_4 . HF$, 2% Citric Acid, 10% HCOOH, 30 min. 70° C. | 5 | 0 | 1.4 | 0 | 1 | 126 | 264 | 98 |
| 8% $ZrOCl_2 . 6H_2O$, 4.8% $NH_4 . HF$, 0% Citric Acid, 10% HCOOH, 30 min. 70° C. | 6 | 0 | 0.8 | 2.1 | 1.3 | 155 | 347 | 125 |

All treatments applied by exhaustion, liquor ratio 1:15.
B.T. - burning time in seconds.
C.L. - char length in inches.
Dm Corr - maximum specific optical density
$SON_4$ - rate of smoke emission during first 4 minutes
$Ds_{t=4\ min}$ - Specific optical density after 4 minutes As is apparent from the results set forth in Table I, treatment with those complexes wherein the F/Zr molar ratio is less than about 4 results in $D_{st=4\ min}$ values of less than about 100 whereas those outside this range produce higher values.

It should be noted that treatment with those complexes containing no fluoride and low percentages of zirconium (i.e., 8% $ZrOCl_2$ in Table I) may not produce adequate flame resistance properties. Those complexes containing fluoride are easily incorporated into the fibers at low temperatures and give high add-on values in relatively short periods of time. The complexes containing no fluoride are incorporated with more difficulty since they must be applied at the boil. Moreover, the complexes containing no fluoride require higher add-on values to achieve flame resistance. Note that Table I shows that where the concentration of $ZrOCl_2$ is increased to 10% satisfactory flame resistance properties are imparted to the fabric.

EXAMPLE II

A wool upholstery fabric, 560 g/m$^2$, was flameresist treated according to the conditions set forth in Table II. The fluorocitratozirconate treatments with a F/Zr ratio of 2 to 3 produce the lowest smoke emission with an adequate degree of flame resistance.

TABLE II

| Treatment | F/Zr Ratio | Flame Resistance AATCC 34 - 1969 Warp B.T. | Warp C.L. | Weft B.T. | Weft C.L. | Smoke Emission Flaming Conditions. Dm Corr | $SON_4$ | $Ds_{t=4\ min}$ |
|---|---|---|---|---|---|---|---|---|
| 12.2% $Zr(Ac)_4$, 1.2% $K_2ZrF_6$, 10% Citric Acid, 10% HCOOH 30 min 70° C. | 1 | 2 | 4.2 | 4 | 1.6 | 132 | 369 | 124 |
| 10% $Zr(Ac)_4$, 2.3% $K_2ZrF_6$, 8% Citric Acid, 10% HCOOH 30 min 70° C. | 2 | 2.5 | 1.3 | 5 | 2 | 78 | 130 | 56 |

TABLE II-continued

| Treatment | F/Zr Ratio | Flame Resistance AATCC 34 - 1969 Warp B.T. | Warp C.L. | Weft B.T. | Weft C.L. | Smoke Emission Flaming Conditions. Dm Corr | $SON_4$ | $Ds_{t=4\ min}$ |
|---|---|---|---|---|---|---|---|---|
| 7.7% $Zr(Ac)_4$, 3.5% $K_2ZrF_6$, 6% Citric Acid, 10% HCOOH 30 min 70° C. | 3 | 0 | 1 | 1 | 0.8 | 101 | 219 | 85 |
| 5.3% $Zr(Ac)_4$, 4.7% $K_2ZrF_6$, 4% Citric Acid, 10% HCOOH 30 min 70° C. | 4 | 0 | 1 | 1 | 1 | 157 | 343 | 131 |
| 3.1% $Zr(Ac)_4$, 5.8% $K_2ZrF_6$, 2% Citric Acid, 10% HCOOH 30 min 70° C. | 5 | 2 | 1 | 1 | 1.2 | 195 | 434 | 162 |
| 7% $K_2ZrF_6$, 10% HCOOH, 30 min 70° C. | 6 | 4 | 2 | 2.5 | 1.2 | 163 | 432 | 145 |

$Zr(Ac)_4$ - zirconium acetate solution containing 22% $ZrO_2$
All treatments applied by exhaustion, liquor ratio 1:15
B.T. - burning time in seconds
C.L. - chair length in inches
The evluated parameters for smoke emission are explained in Table I It may also prove advantageous to apply the flame resist agent from an organic solvent system. There are numerous sensitive fabric constructions which are affected by relaxation and/or felting shrinkage during a low temperature aqueous flame-proofing treatment. Moreover, there already exist various treatments of keratin fibers with organic solvent systems. For example, there are finishes which rely on wet processes based entirely on solvent treatments.

Accordingly, it would be advantageous to incorporate the present flame-proofing system into the existing organic solvent treatments.

This may be achieved by emulsifying the above-described aqueous solution of flame-resist agent in an organic solvent inert with respect to said polyamide fibers such as aliphatic hydrocarbons and halogenated derivatives thereof, e.g., white spirit, perchloroethylene, trichloroethylene, chloroform, tetrachloromethane and aromatic solvents.

Where necessary conventional emulsifying agents, preferably non-ionic agents, may be employed.

It is generally preferable that the aqueous phase form a minor part of the emulsion, typically 1–20%, preferably 1–10% on the weight of the fiber treated (O.W.F.).

What is claimed is:

1. A process for improving the flame-resist properties of natural polyamide fibers comprising applying to said fibers an aqueous solution consisting of water, an anionic complex of zirconium, Citric acid, fluoride and sufficient formic acid such that said solution has a pH in the range of 0.5 to 4.0, whereby to impregnate the substance of said fibers with said anionic complex and thereafter drying the fibers, the proportion of said zirconium complex in relation to said fibers being sufficient to satisfy at least the minimum requirements of the Vertical Flame Test - A.A.T.C. Test Method 34-1969, Fire Resistance of Textile Fabrics, and the molar ratio of fluoride to zirconium being less than about 4 such that the smoke emission ($Ds_{t\text{-}4\ min}$) of said fibers, after drying, is not more than about 100.

2. The process of claim 1, wherein said anionic complex is formed in situ by reaction of a water soluble zirconium compound with a sufficient amount of citric acid and a fluoride.

3. The process of claim 2, wherein said soluble zirconium compound is zirconium oxychloride or acetate and said fluoride is ammonium bifluoride.

4. The process of claim 1, wherein said solution is applied at a temperature of 10° to 100° C.

5. The process of claim 1, wherein the anionic zirconium complex is applied in an amount from about 2 to about 12% calculated as the weight of $ZrO_2$ on the weight of the fibers.

6. The process of claim 1, wherein the complex is applied to said fibers from an emulsion of said aqueous solution in an organic solvent inert with respect to said polyamide fiber.

* * * * *